US005636378A

United States Patent [19]

Griffith

[11] Patent Number: 5,636,378

[45] Date of Patent: Jun. 10, 1997

[54] IMPACT SENSING VEST

[76] Inventor: Quentin L. Griffith, 1402 S. 14th, Chickasha, Okla. 73018

[21] Appl. No.: 488,564

[22] Filed: Jun. 8, 1995

[51] Int. Cl.[6] ..... A41D 13/00; A41D 1/04; G08B 21/00

[52] U.S. Cl. ..... 2/455; 2/905; 2/102; 2/463; 2/464; 340/605; 455/100

[58] Field of Search ..... 2/905, 906, 2, 2/102; 273/57.3, 371, 372, 378; 455/100, 66; 340/825.19, 573, 574, 575, 576, 603, 604, 605

[56] References Cited

U.S. PATENT DOCUMENTS 5,557,263 9/1996 Fisher et al. ..... 340/605

*Primary Examiner*—Paul C. Lewis

[57] ABSTRACT

An apparatus comprising a vest constructed using woven tubing which generally forms a mesh throughout the vest. The tubing is connected with a reservoir, wherein the tubing and reservoir are filled with electrically conductive fluid. The fluid communicates with a pair of leads to maintain a constant, low-level electrical contact therebetween. The woven tubing is covered with cloth-like material and a hardening substance, such as epoxy. Hence, the tubing will break when the vest receives a significant impact. When the tubing is broken, the fluid escapes from the tubing and breaks the electrical contact between the leads, whereby a transmitter is activated to send a recorded message. In addition, a position sensor is attached to the transmitter for activating the transmitter to send the recorded message if the apparatus is maintained in a non-vertical position for a predetermined period of time.

20 Claims, 1 Drawing Sheet

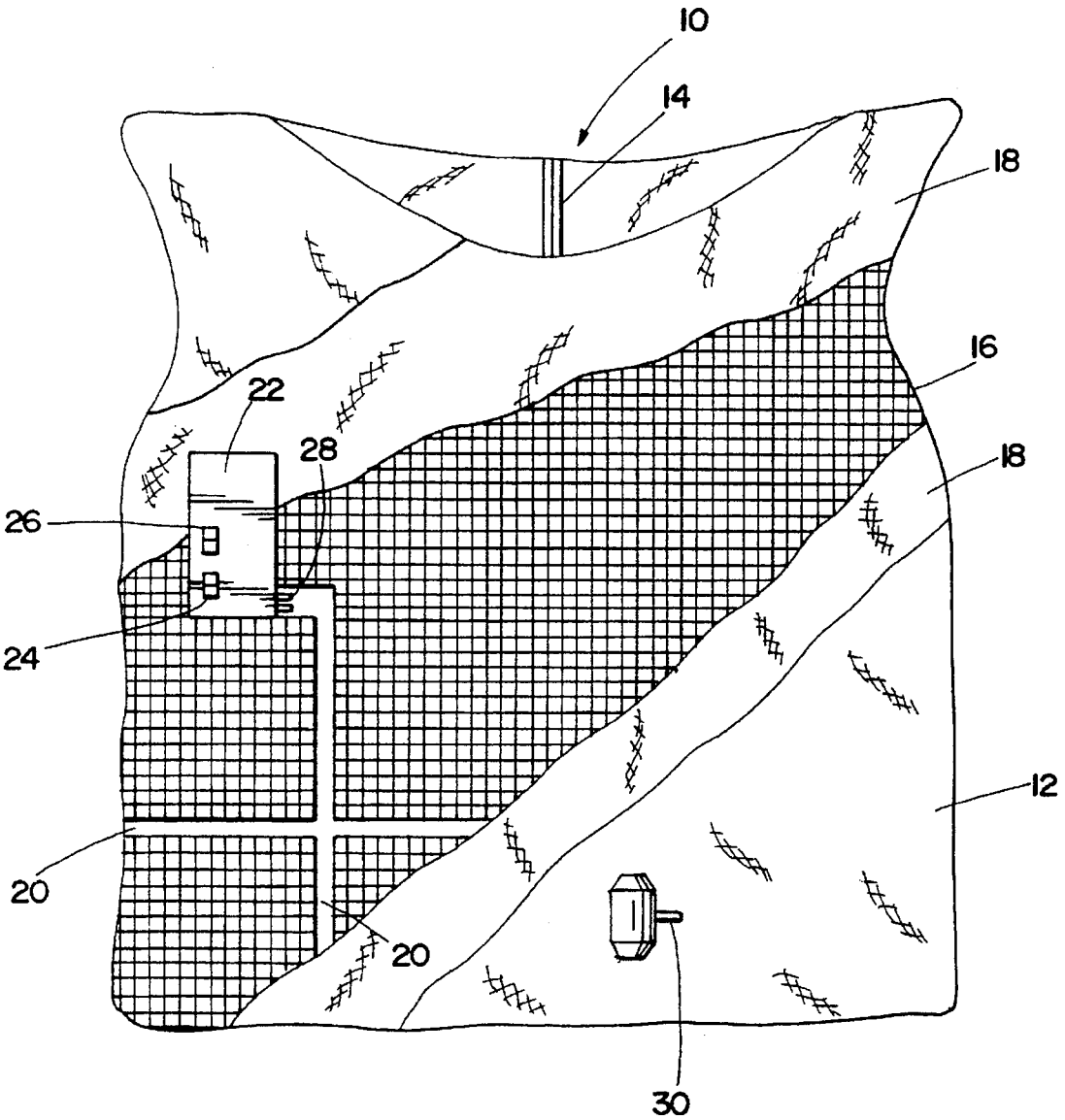
10
14
18
16
22
28
18
26
24
12
20
20
30

IMPACT SENSING VEST

BACKGROUND

The present invention relates generally to an impact sensing apparatus for a person's torso, and more particularly, to a vest which detects impact therewith and transmits a digitally recorded message.

Numerous vests are known in the art; however, no known vest provides means for sensing an impact therewith or transmitting a recorded message. Safety type vests are commonly used for inhibiting projectiles but do not provide impact sensing capabilities or transmitter activation upon sensing the impact.

Hence, there is a need for a simple, economical and effective apparatus which generally covers a person's torso for sensing impact therewith and activating a transmitter to send a recorded message; however, until now, no such apparatus has been developed.

SUMMARY

The preferred embodiment of the invention is directed to an apparatus which senses impact therewith and activates a transmitter to send a recorded message. The apparatus comprises a vest which is constructed using woven tubing, wherein the tubing generally forms a tight mesh throughout the vest. The tubing is connected with a reservoir of electrically conductive fluid; thus, the fluid fills the tubing and reservoir. Moreover, the fluid communicates with a pair of leads for maintaining a constant and low-level electrical contact therebetween.

The woven tubing is covered with cloth and a hardening substance, such as epoxy; wherefore, the tubing will break when the vest receives a significant impact. When the tubing is broken, the fluid escapes from the tubing and breaks the electrical contact between the leads, thereby activating a transmitter to send a recorded message. In addition, a position sensor is attached to the transmitter for activating the transmitter to send the recorded message when the apparatus is maintained in a non-vertical position for a predetermined period of time.

As such, it is a first object of the present invention to provide an efficient, economical, and simple apparatus which generally covers a person's torso and senses impact.

It is a further object of the present invention to provide an apparatus which has woven tubing for containing an electrically conductive fluid.

It is a further object of the present invention to provide an apparatus having a transmitter for sending a digitally recorded message, wherein the transmitter is activated by the apparatus receiving and sensing an impact.

It is a final object of the present invention to provide an apparatus having a transmitter to send a recorded message when a position sensor determines that the apparatus is maintained in a non-vertical position for a predetermined period of time.

BRIEF DESCRIPTION OF THE DRAWING

These and other features, aspects, and advantages of the present invention will become better understood with regard to the following description, appended claim, and accompanying drawing which illustrates a partially broken-away front elevation view of an impact sensing vest constructed in accordance with the present embodiment of the invention.

DESCRIPTION

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications, and equivalents, which may be included within the spirit and scope of the invention as defined by the appended claims.

As illustrated in the drawing, the preferred version of an impact sensing apparatus 10 includes a vest 12 for substantially covering the trunk of a person's body. The vest 12 utilizes a conventional closure 14, such as a zipper, buckle, snap or the like, for holding the vest 12 on the person's body.

The vest 12 is preferably constructed using woven tubing 16 made of plastic or other suitable material, wherein the tubing 16 generally forms a tight mesh throughout the vest 12. Moreover, the tubing 16 is covered with a cloth-like material 18 and a hardening substance, such as epoxy, wherein the tubing 16 will break when it receives a significant impact.

The tubing 16 is in communication with a reservoir 20 of electrically conductive fluid, such as artificial plasma or the like which is safe for human contact. Hence, the tubing 16 and reservoir 20 are combined to form a sealed network for containing the fluid.

As shown in the drawing, a short range transmitter 22, which is known in the art for sending digitally recorded information, is attached to the vest 12 and operated by a power means (not shown), such as a battery or other DC power source. A power switch 24 is provided to control the supply of power delivered from the power means, and a transmitter switch 26 is provided to control the supply of power delivered to the transmitter 22. Preferably, the transmitter 22 includes a curved steel jacket for encasing and protecting the components thereof.

Additionally, two pair of leads 28 communicate with the power means and fluid, wherein each pair of leads 28 maintains a constant and low-level electrical contact therebetween. Preferably, one pair of leads 28 is located near the person's shoulders while the second pair of leads (not shown) is located near the person's waist.

The leads 28 are connected with the transmitter 22 to provide means for sensing loss of the fluid from the network; thus, the transmitter 22 is activated whenever the fluid loss causes the electrical contact to be broken between the leads 28. Moreover, a ground wire (not shown) is provided between the fluid and power means.

When the vest 12 receives an impact, the force breaks the tubing thereby releasing the fluid therefrom. Thus, as the fluid is released, the electrical contact is broken between the leads 28 and the transmitter 22 is activated to send a digitally recorded message, which includes the vest's 12 serial or identification number.

Preferably, the transmitter 22 is used in conjunction with a base relay unit (not shown), such as a car radio. Wherefore, the transmitter 22 serves as a means for notifying others that the user, such as a policeman, has received an impact.

A rip cord 30 having a handle attached thereto is positioned on a front portion of the vest 12 and is connected with the tubing 16, wherein the person wearing the vest 12 can manually break the tubing to release the fluid therefrom. Hence, the rip cord 30 provides a means of manually activating the transmitter 22.

In an alternative embodiment (not shown), a position sensor is connected to the transmitter 22, wherein the sensor activates the transmitter 22 to send the recorded message if the apparatus 10 is maintained in a non-vertical position for a predetermined period of time. A preferred sensor includes a plurality of laser diodes which are mounted in an asymmetrically weighted housing, and a photoreceptor for receiving light emitted from the diodes when aligned therewith.

Furthermore, the housing is rotatably mounted in a container, wherein the photoreceptor is permanently affixed thereto. A substance, such as glycerin or the like, is located within the container to slow rotational movement of the housing in response to the apparatus 10 being moved into a non-vertical position. Thus, a person wearing the vest 12 may bend over for a limited amount of time without activating the transmitter 22.

In operation, the vest 12 substantially covers a person's torso and is energized by the power means, which is controlled by the power switch 24. When the power switch 24 is turned on, the leads 28 maintain a constant and low-level electrical contact therebetween. Moreover, the transmitter switch 26 controls whether the transmitter 22 can be activated.

Upon the vest 12 receiving a significant impact, the tubing 16 is broken and the fluid is released from the tubing 16 and communicating reservoir 20. Additionally, the rip cord 30 can be manually pulled to break the tubing 16 in the absence of an impact to the vest 12. As the fluid is lost from the tubing 16 or associated reservoir 20, the constant electrical contact is broken between the leads 28.

Hence, the broken contact between the leads 28 activates the transmitter 22 to send a recorded message. Additionally, the transmitter 22 may be activated by the position sensor if the apparatus 10 is maintained in a non-vertical position for a predetermined period of time.

The present embodiment of the invention is not intended to be limited to only those items illustrated herein, but rather, includes items which are known in the art and are not necessary for understanding the present invention. Therefore, the drawings has been simplified to eliminate many of the known electrical and transmitting components associated with the apparatus 10.

The previously described versions of the invention have many advantages, including a simple, economic and safe way to construct the impact sensing apparatus 10. Further, the apparatus 10 is advantageous in providing the transmitter 22 for sending a digitally recorded message.

The foregoing descriptions of specific embodiments of the present invention have been presented for purposes of illustration and description. They are not intended to be exhaustive or to limit the invention to the precise forms disclosed and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. An impact sensing apparatus, comprising:

a vest having woven tubing;

a reservoir in communication with the tubing, wherein the tubing and said reservoir form a sealed network for containing an electrically conductive fluid;

wherein the tubing is capable of losing the fluid;

means for sensing a loss of the fluid from the network;

means for transmitting a message; and wherein said means for sensing activates said means for transmitting when fluid is lost from the tubing.

2. The apparatus of claim 1 wherein the tubing forms a mesh.

3. The apparatus of claim 1 wherein the tubing is covered with a cloth-like material and a hardening substance.

4. The apparatus of claim 1 wherein said means for transmitting includes a transmitter.

5. The apparatus of claim 4 wherein said means for sensing includes a pair of leads connected to said transmitter.

6. The apparatus of claim 4 wherein said means for sensing includes two pair of leads connected to said transmitter.

7. The apparatus of claim 4 wherein said transmitter sends digitally recorded information.

8. The apparatus of claim 1 further comprising a power switch.

9. The apparatus of claim 1 further comprising means for manually activating said means for transmitting.

10. The apparatus of claim 9 wherein said means for manually activating includes having a rip cord connected with the tubing.

11. An impact sensing apparatus, comprising:

a garment having means for containing an electrically conductive fluid, wherein said means for containing is capable of losing the fluid;

means for sensing a loss of the fluid from said means for containing;

means for transmitting a message; and wherein said means for sensing activates said means for transmitting when there is a loss of the fluid from said means for containing.

12. The apparatus of claim 11 wherein said means for containing includes tubing.

13. The apparatus of claim 12 wherein the tubing forms a mesh.

14. The apparatus of claim 12 wherein the tubing is covered with a cloth-like material and a hardening substance.

15. The apparatus of claim 11 wherein said means for transmitting includes a transmitter for sending digitally recorded information.

16. The apparatus of claim 11 wherein said means for sensing includes a pair of leads connected to said means for transmitting.

17. The apparatus of claim 11 further comprising a power switch.

18. The apparatus of claim 11 further comprising means for manually activating said means for transmitting, said means for manually activating includes having a rip cord connected with said means for containing.

19. An impact sensing apparatus, comprising:

an electrically conductive fluid;

a garment having means for containing said fluid, wherein said means for containing is capable of losing the fluid;

means for sensing a loss of said fluid from said means for containing;

means for transmitting a message; and wherein said means for sensing activates said means for transmitting when there is a loss of said fluid from said means for containing.

20. The apparatus of claim 19 wherein said garment is a vest having woven tubing.

* * * * *